US005554055A

United States Patent [19]

Miller

[11] Patent Number: 5,554,055

[45] Date of Patent: Sep. 10, 1996

[54] ELECTRICAL CONNECTOR EMPLOYING DUAL LOCKING CONTACT RETENTION

[75] Inventor: Steven D. Miller, Conway, Ark.

[73] Assignee: Thomas & Betts Corporation, Memphis, Tenn.

[21] Appl. No.: 298,815

[22] Filed: Aug. 31, 1994

[51] Int. Cl.[6] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 2,822,529 | 2/1958 | Heath . | |
| 3,359,533 | 12/1967 | Barry . | |
| 3,389,371 | 6/1968 | Maynard . | |
| 3,544,954 | 12/1970 | Yeager . | |
| 3,550,067 | 12/1970 | Hansen . | |
| 3,573,720 | 4/1971 | Reynolds | 439/697 |
| 3,686,617 | 8/1972 | Uberbacher . | |
| 3,915,538 | 10/1975 | Gruhn, Jr. et al. . | |
| 4,083,615 | 4/1978 | Volinskie . | |
| 4,255,009 | 3/1981 | Clark . | |
| 4,274,700 | 6/1981 | Keglewitsch et al. . | |
| 4,557,543 | 12/1985 | McCleerey et al. . | |
| 4,636,020 | 1/1987 | Marmillion . | |
| 4,721,478 | 1/1988 | Sonobe | 439/278 |
| 4,758,182 | 7/1988 | Anbo et al. | 439/752 |
| 4,867,711 | 9/1989 | Yuasa | 439/752 |
| 4,891,021 | 1/1990 | Hayes et al. | 439/599 |
| 4,957,451 | 9/1990 | Nadin | 439/395 |
| 4,984,998 | 1/1991 | Duncan et al. | 439/352 |
| 5,052,949 | 10/1991 | Lopata et al. | 439/610 |
| 5,082,461 | 1/1992 | Minnis et al. | 439/786 |
| 5,118,306 | 6/1992 | Bixler et al. | 439/405 |
| 5,295,871 | 3/1994 | Lapraik et al. | 439/746 |
| 5,403,211 | 4/1995 | Sayer et al. | 439/752 |

FOREIGN PATENT DOCUMENTS

| | | |
|---|---|---|
| 2555871 | 6/1977 | Germany . |
| 496765 | 1/1939 | United Kingdom . |
| 858692 | 1/1961 | United Kingdom . |
| 1097280 | 2/1966 | United Kingdom . |

OTHER PUBLICATIONS

SCSI–2 Draft Proposed American National Standard, pp. (4–3)—(4–24), Mar. 9, 1990, Revision 10c.

*Primary Examiner*—Gary F. Paumen
*Attorney, Agent, or Firm*—Salvatore J. Abbruzzese

[57] ABSTRACT

An electrical connector assembly securely locks electrical contacts within a connector housing. The connector assembly includes a plurality of electrical contacts each having first and second longitudinally spaced locking elements. A connector housing includes an interconnection end and a contact insertion end. The connector housing also includes an initial contact support member positioned adjacent the insertion end of the housing. The initial contact support member includes a plurality of apertures permitting insertable passage of the contacts therethrough. Engagement elements on the initial contact support member engage the first locking element of the contacts preventing inadvertent withdrawal of the contacts from the housing. A final contact support member is movably positioned adjacent the interconnection end of the housing. The final contact support member includes contact passage apertures therethrough. Each contact passage aperture has a first aperture portion which permits insertion of the contacts therethrough and a second aperture portion which restricts withdrawal of the contacts therethrough. The final contact support member is movable within the housing to move from a first position permitting contact passage through the apertures to a second position preventing contact passage through the apertures.

14 Claims, 3 Drawing Sheets

ELECTRICAL CONNECTOR EMPLOYING DUAL LOCKING CONTACT RETENTION

FIELD OF THE INVENTION

The present invention relates generally to an electrical connector used to terminate plural electrical conductors. More particularly, the present invention relates to an electrical connector which insertably supports a plurality of terminated electrical contacts in a connector housing and which locks the inserted contacts in the housing preventing inadvertent withdrawal.

BACKGROUND OF THE INVENTION

Electrical connectors which insertably accommodate plural terminated electrical contacts have long been known. Connectors such as these are used to interconnect electrical conductors which may carry electrical signals or electrical power. In certain applications, such as in computer or automotive use, it has become common to miniaturize the connectors, that is provide smaller connector components, while still maintaining the ability to terminate numerous conductors.

As the interconnection scheme for plural conductors may differ in each application, it is quite common for a connector manufacturer to supply discrete connector assembly components, such as an insulative housing and plural electrical contacts, to an end user. The end user would terminate the individual conductors to the contacts and then insert the contacts into the connector housing in a specified pattern dictated by the particular customer application.

As the end user must reliably and quickly construct numerous connector assemblies, the components supplied by the connector manufacturer must be easy to assemble in a reliable fashion. Also, in use, these connectors may be subjected to repeated connections and disconnections (mating cycles). The electrical contacts which terminate the electrical conductors must therefore be securely retained within the connector housing so as to withstand such repeated mating cycles. While in order to facilitate ease of assembly, the contacts must be easily inserted into the connector housing; the contacts must also be able to withstand repeated connections and disconnections.

Also, during assembly and at a time thereafter, there may be a need to replace or reposition a contact inserted into a connector housing. Such repositioning may be dictated by a change in a wiring pattern or to correct a mistakenly positioned contact. Thus while it is desirable to securely lock the contact in the connector housing during use, it cannot be permanently fixed therein. Thus, the contacts must also be removable in certain instances to provide for replacement or repositioning.

The art has seen various constructions of connector housings and electrical contacts which permit insertable retention of the contacts in the housing. Common among these examples are electrical contacts being formed with spring biased fingers or flanges which may be compressed upon insertion into an opening in the housing and then spring back engaging a portion of the housing preventing withdrawal thereof. Such examples are shown in U.S. Pat. Nos. 4,557,543 and 5,295,871. These patents also disclose the use of an appropriate tool which can effect withdrawal of the contact from the housing for replacement or repositioning.

While the connectors shown in the above-identified patents adequately support and lock the contacts in the connector housing when properly assembled, there exists the possibility that the contacts may be incorrectly inserted into the housing in a manner where full contact locking does not take place. An end user would be unaware of this improper insertion. Thus, upon interconnection during use, a contact may dislodge from the housing rendering the electrical connection ineffective.

It is therefore desirable to provide an electrical connector which incorporates redundant locking mechanisms to assure proper locking of the contact in the connecting housing. Also, such a connector would prevent interconnection with a mating connector unless the contacts are properly locked in the connector housing.

SUMMARY OF THE INVENTION

It is an object of the present invention to provide an electrical connector which insertably accommodates contacts terminating electrical conductors.

It is a further object of the present invention to provide an electrical connector including a connector housing which securely retains terminated electrical contacts which are inserted thereinto.

It is a still further object of the present invention to provide an electrical connector housing which accommodates, in locking fashion, terminated contacts inserted thereinto and prevents the inadvertent withdrawal thereof.

It is yet another object of the present invention to provide an electrical connector housing having dual locking elements which simultaneously engage electrical contacts to securely lock the contacts therein.

In the efficient attainment of these and other objects, the present invention provides an electrical connector assembly. The assembly includes an insulative connector housing. The connector housing has a contact supporting first surface and a contact supporting second surface which is spaced from the first surface. The contact supporting first surface includes first apertures therethrough and the contact supporting second surface includes second apertures therethrough which are aligned with the first apertures. Elongate electrical contacts are supported by the housing. Each contact is insertable into the housing and includes first and second locking elements which are spaced apart and insertable through the first and second apertures of the respective first and second contact supporting surfaces. Each of the first and second contact supporting surfaces include locking means cooperatively engageable with the first and second locking elements of the contacts for independently providing locking engagement between the first and second housing surfaces and the first and second locking elements.

As more particularly described by way of the preferred embodiment herein, a plurality of elongate electrical contacts are provided. Each contact has a connection end, an opposed conductor terminating end and a central portion therebetween. The central portion includes first and second longitudinally spaced locking elements. An elongate connector housing includes an interconnection end and a contact insertion end for insertably receiving the contacts. The connector housing includes an initial contact support member positioned adjacent the insertion end which includes a plurality of initial apertures permitting insertable passage of the contacts through the initial contact support member in an insertion direction. The initial contact support member includes engagement elements adjacent each initial aperture for locking engagement with first locking element of the contacts preventing inadvertent movement of the contacts in a withdrawal direction. The housing further includes a final contact support member movably positioned in the housing adjacent the interconnection end thereof. The final contact support member includes a plurality of final apertures each shaped to include a first aperture portion designed to permit passage of the second locking member of the contact therethrough and a second aperture portion in communication with the first, dimensioned to prevent passage of the second locking element therethrough. The final contact support member is movably supported within the housing to move from a first position permitting contact passage through the final aperture to a second position preventing contact passage through the final aperture.

DETAILED DESCRIPTION OF THE PREFERRED EMBODIMENTS

Figure 1:
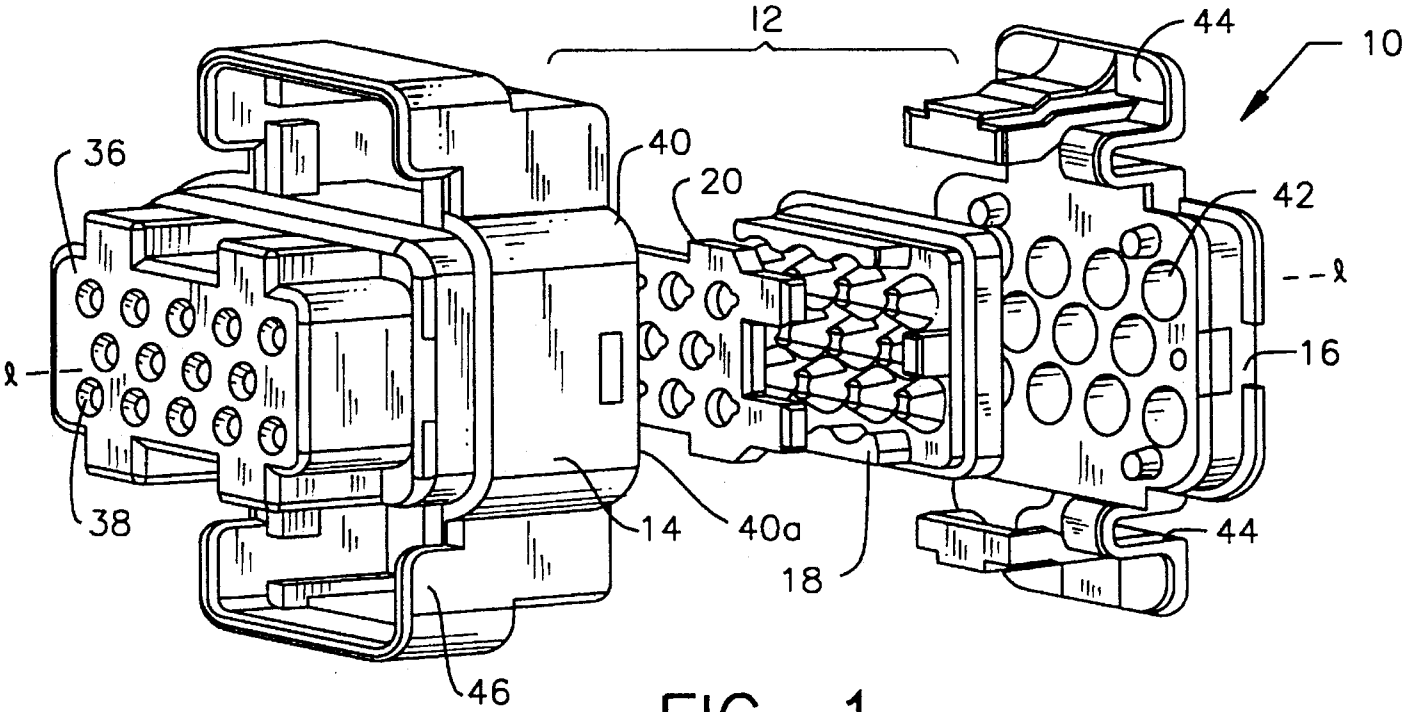
FIG. 1 is an exploded perspective view of an electrical connector assembly of the present invention.

Referring to FIG. 1, an electrical connector assembly 10 of the present invention is shown. Connector assembly 10 includes an elongate insulative connector housing 12 shown aligned along axis l in exploded view in FIG. 1. Connector housing 12 includes a base 14, a cover 16, an initial contact support member 18 and a final contact support member 20. Contact support members 18 and 20 are supported between base 14 and cover 16. Each of the components of housing 12 are formed of a suitably insulated plastic material. In the present illustrative embodiment base 14, cover 16 and initial contact support member 18 are formed of a PPO/nylon blend such as the type sold under the General Electric trademark NORYL®. Final contact support member 20 may be preferably formed of a PPA thermoplastic.

Figure 3:
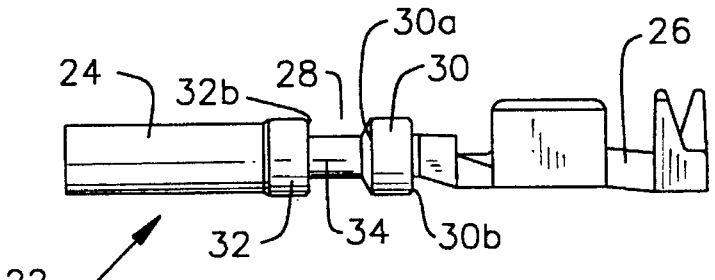
FIG. 3 is a side plan view of the electrical contact shown in FIG. 2.
Figure 2:
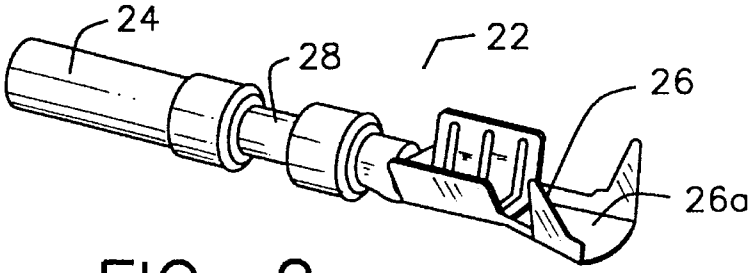
FIG. 2 is a perspective showing of an electrical contact used in the connector assembly shown in FIG. 1.

Referring to FIGS. 2 and 3, an electrical contact 22, which may be accommodated in housing 12, is shown. Contact 22 is an elongate suitably conductive member preferably formed of beryllium copper. Contact 22 has a connection end 24, a conductor terminating end 26 and a central portion 28 lying therebetween. In the present embodiment shown in FIGS. 2 and 3, connection end 24 is formed into a conventional socket or barrel which would accommodate a pin-type electrical contact therein. However, as is well known in the connector art, other shapes of connection end 24 may also be employed. Connector terminating end 26 includes a conductor receiving nest **26*a* which accommodates the stripped end of an electrical conductor (not shown) therein. In conventional fashion, conductor terminating end 26 may be crimped around the bared extent of the electrical conductor to establish electrical connection therebetween. As is well known in the electrical connection art, suitable crimping tools (not shown) may be used to effect termination of an electrical conductor to contact 22**.

The central portion 28 of contact 22 includes a pair of longitudinally spaced contact shoulders 30 and 32 spaced by a narrow intermediate extent 34. Contact shoulders 30 and 32 form raised or enlarged portions of contact 22 and as will be described in further detail hereinbelow, cooperate with support members 18 and 20 to secure contact 22 within housing 12.

Figure 4:
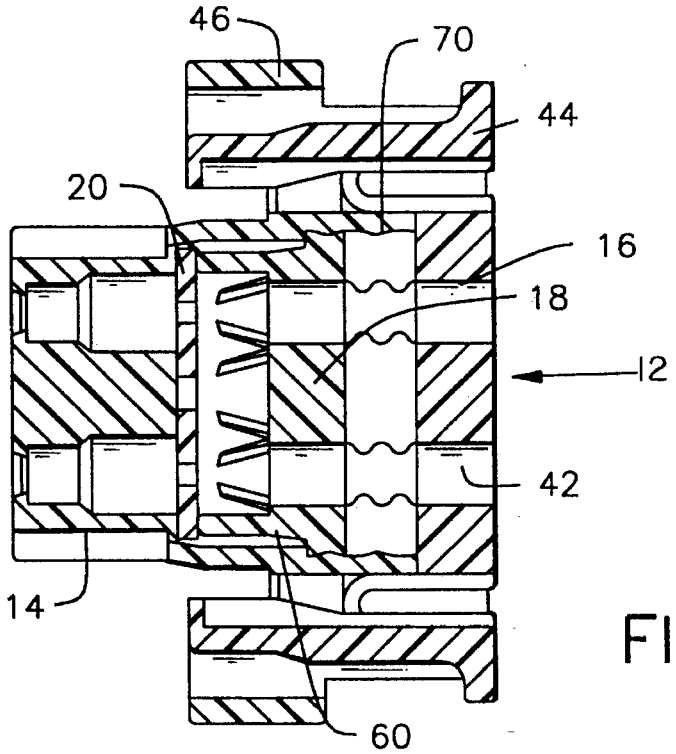
FIG. 4 is a vertical sectional showing of a further embodiment of an electrical connector of the present invention.

Referring again to FIG. 1, base 14 of connector assembly 10 includes a forward interconnection end 36 which is configured to insertably mate with a mating electrical connector (not shown) to establish electrical connection between contacts 22 supported within housing 12 and complementary contacts supported within the mating connector. Interconnection end 36 includes a plurality of openings 38 therethrough, which permit interconnection access to the connection end 24 of contacts 22. Base 14 includes a contact receiving end 40 adjacent the open end of base 14 which is longitudinally opposed to interconnection end 36. The open end of base 14 is closed by cover 16 which is snap fitted thereover. Cover 16 includes a plurality of openings 42 therethrough which are aligned with openings 38 of base 14 to permit insertion of contacts 22 thereinto when cover 16 is snapped onto base 14. Cover 16 includes a pair of upper and lower cover latches 44 which are insertable into recesses 46 in base 14. Latches 44 and recesses 46 are used in combination to mechanically secure housing 12 to a mating electrical connector. The interengagement of latches 44 in recesses 46 is more clearly shown in FIG. 4. Appropriate cooperating latching structure would be provided on the mating connector (not shown) to enable latching interconnection therewith. Contact support members 18 and 20 are positioned between base 14 and cover 16.

Figure 6:
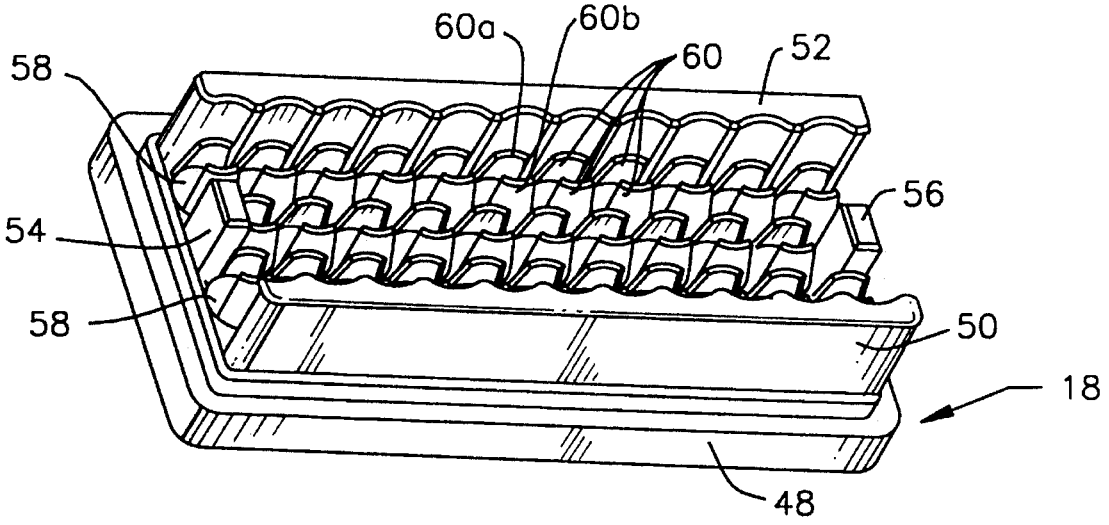
FIG. 6 is a perspective showing of an initial contact support member forming part of the electrical connector assembly of the present invention.

Referring additionally to FIG. 6, initial contact support member 18, which is positioned adjacent cover 16, is shown. Initial contact support member 18 is a generally rectangular member including a perimetrical rim 48 and a pair of outwardly extending walls 50 and 52 which extend along opposed longitudinal sides of rim 48. A pair of outwardly extending positioning posts 54 and 56 extend from opposed transverse sides of rim 48 and help to properly position initial contact support member 18 within housing 12. Initial contact support member 18 includes a plurality of generally circular apertures 58 therethrough. Apertures 58 are arranged in a pattern generally identical to the pattern of openings 38 and 42 of base 14 and cover 16 respectively.

About each aperture 58, initial contact support member is constructed to include a pair of diametrically opposed outwardly extending generally frustoconical fingers 60, a pair of such fingers about each aperture 58 being defined as fingers **60*a* and 60*b*. As fingers 60 are integrally formed with plastic initial contact support member 18, fingers 60 are somewhat resilient, that is, they can be partially deflected and will return to their original position. In this regard fingers 60 serve to secure contact 22 therebetween. Opposed fingers 60*a* and 60*b* form a generally frustoconically shaped extension about each aperture 58. The diameter of the frustum of the cone at the narrow end is constructed to be less than the diameter of contact shoulder 30 of contact 22 as shown in FIG. 3. A forward portion 30*a* of contact shoulder 30 is tapered forming a lead-in surface. Upon insertion of contact 22 through aperture 58, fingers 60*a* and 60*b* expand over forward tapered portion 30*a* and snap back behind shoulder 30 to engage an abutment surface 30*b* to secure contact 22** therein. This will be described in further detail hereinbelow.

Figure 7:
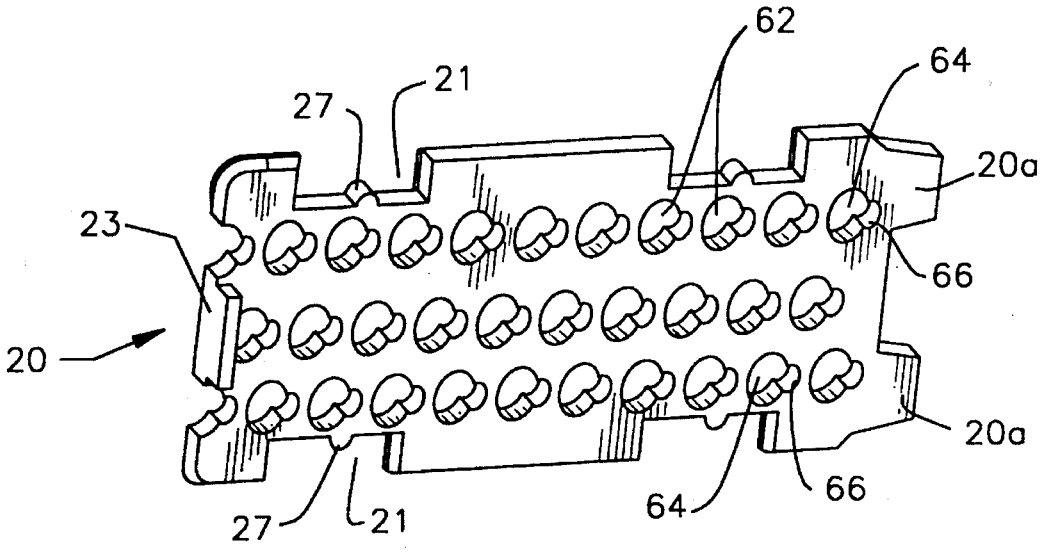
FIG. 7 is a perspective showing of a final contact support member forming part of the electrical connector assembly of the present invention.

Referring additionally to FIG. 7, final contact support member 20 is shown. Contact support member 20 is generally a rectangular planar member having a pattern of apertures 62 therethrough. Apertures 62 are generally positioned to correspond to the position of apertures 58 in initial contact support member 18. Final contact support member 20 includes a perimetrical structure in the form of indentations 21 thereabout which helps to movably position final contact support member 20 within housing 12 as will be described in further detail hereinbelow.

Apertures 62 have a generally "key-hole" shape including a first larger circular aperture portion 64 and a smaller laterally extending second aperture portion 66 in communication therewith. First aperture portion 64 is dimensioned so as to permit passage therethrough of contact shoulder 32 of contact 22. First aperture portion 64 is slightly larger than contact shoulder 32 permitting such passage therethrough. Second aperture portion 66 of aperture 62 is dimensioned to be smaller than shoulder 32 of contact 22 so as to restrict its passage through second aperture portion 66. Final contact member 20 is movably positioned within housing 12 so as to be laterally movable from a first position where first aperture portion 66 is in alignment with aperture 58 of initial contact support member 18 and openings 38 and 42 of base 16 and cover 16 respectively. In this position contacts 22 may be insertably positioned from the rear of cover 16 into base 14 through support members 18 and 20. Once contacts 22 are properly positioned within housing 12, final contact support member 20 may be laterally moved so that second aperture portion 66 is in alignment with contact shoulder 32. An abutment surface **32*b* of shoulder 32 bears against the wall peripherally about second aperture portion 66 preventing withdrawal of the contact 22** therefrom.

Having described the components of the present invention, its assembly may now be described.

Figure 5:
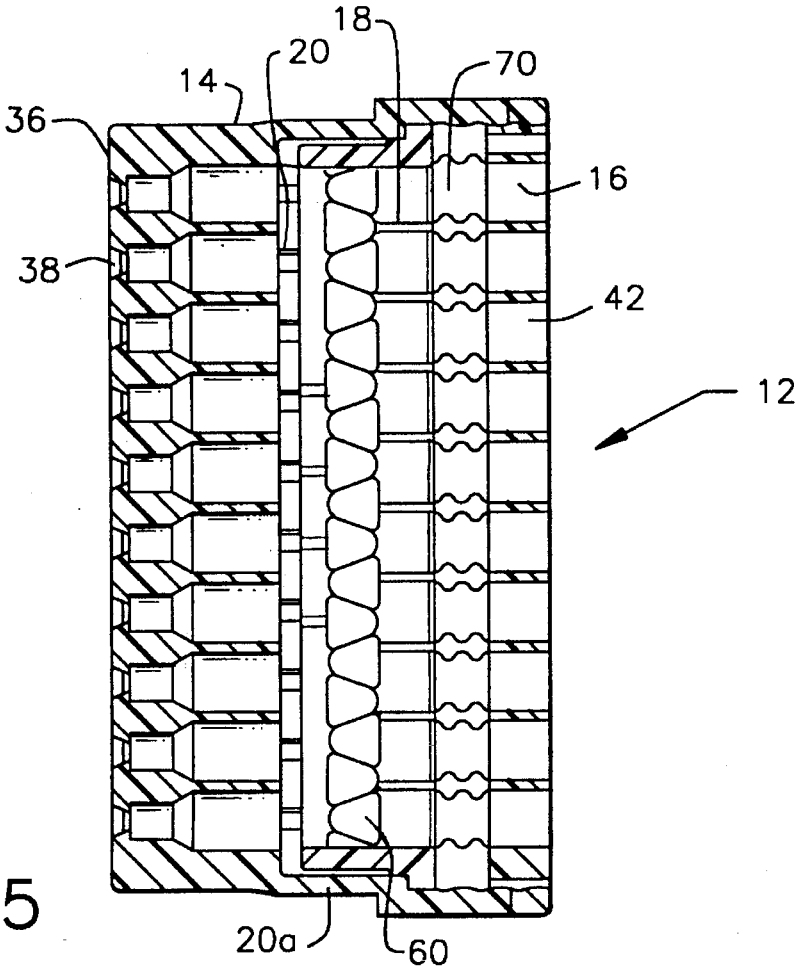
FIG. 5 is a horizontal sectional showing of the electrical connector of FIG. 4.

Housing 12, shown in FIG. 1, may be assembled by first inserting final contact support member 20 within base 14 through the open end 40 thereof. Arm 23 extending from final contact support member 20 provides for proper orientation. Initial contact support member 18 is inserted therebehind with posts 54 and 56 properly positioning both support members 18 and 20 within the cavity of base 14. Final contact support member 20 is laterally movable within base 14, it being manually actuatable by extending portions **20*a* which extend exteriorly of base 14 as will be described in further detail hereinbelow. Cover 16 is then snap fitted over the open end 40*a* of base 14 securing both initial contact support member 18 and final contact support member 20 within housing 12. Conventional snap fitting structures on both cover 16 and base 14 provide for such securement. While not shown in FIG. 1, but shown in FIGS. 4 and 5, a resilient apertured gasket 70 may be interposed between cover 16 and initial contact support member 18 to provide a seal about contacts 22** inserted therethrough.

With housing 12 so assembled, insertion of contacts 22 thereinto may take place. A user would terminate an individual insulated electrical conductor (not shown) to contact 21 by placing a stripped end extent thereof into nest **26*a* of conductor terminating end 26. An appropriate crimping tool would be used to crimp the stripped end of the conductor therein. Thus, conductors would be electrically terminated to the individual contacts 22. As may be dictated by a particular wiring pattern, an installer would individually insert terminated contacts 22 into housing 12 through openings 42 in cover 16. Connection end 24 would be inserted through opening 42. Upon insertion, the barrel forming connection end 24 will pass between opposed fingers 60*a* and 60*b* of initial contact support member 18. This will cause fingers 60*a* and 60*b* to resiliently deflect permitting continued passage of contact 22 therethrough. The fingers will ride over shoulder 32 and snap back into intermediate extent 34. Continued contact insertion causes fingers 60*a* and 60*b* to again deflect and ride over shoulder 30 until they snap back behind shoulder 30 thereby securely locking contact 32 therein. Simultaneously therewith, shoulder 32 will pass through first aperture portion 64 of aperture 62 of final contact support member 20. When the contact 22 is positioned by the locking engagement of opposed fingers 60*a* and 60*b* behind shoulder 30, shoulder 32 will be in a position within aperture 62 permitting lateral movement of final contact support member 20. Such lateral movement causes intermediate extent 34 of contact 22 to be positioned within second aperture portion 66. It can be seen that withdrawal of contact 22 is prevented by the engagement of shoulder 30 with fingers 60*a* and 60*b* of initial contact support member 18 as well as the engagement of shoulder 32 about the smaller second aperture portion 66 of final contact support member 20. Thus, independent redundant locking engagement of contact 22 with housing 12** is provided.

Further, extending portions **20*a* of final contact support member 20 extend exteriorly of housing 12 in its first unlocked position. Upon proper positioning of contacts 22 in housing 12, portions 20*a* may be pushed inwardly of housing 12 (either by finger pressure or use of a suitable tool) to a second position providing locking engagement of final contact support member 20 with contacts 22. Detent structure 27 within indentations 21 help position final contact support member between the first and second position. Interconnection of connector assembly 10 with a mating connector is prevented unless final contact support member 20 is moved to a locking position. Without moving contact support member 20 to a locking position, portions 20*a* will be maintained exteriorly of housing 12 blocking interconnection with a mating electrical connector. Thus, interconnection of connector assembly 10 with a mating connector can only be achieved when contacts 22 are properly locked within housing 12**.

While the redundant locking mechanisms shown and described herein provide for securing locking of contacts 22 in housing 12, thereby preventing inadvertent withdrawal of the contact therefrom, an appropriate tool (not shown) may be employed to spread open fingers **60*a* and 60*b* allowing removal of the contacts. In this regard final contact support member 20 may be laterally moved back to its first position allowing removal of contacts 22 from housing 12. Such removal may be necessitated by the need to replace or reposition a contacts 22 within housing 12**.

Various changes to the foregoing described and shown structures would now be evident to those skilled in the art. Accordingly, the particularly disclosed scope of the invention is set forth in the following claims.

What is claimed is:

1. An electrical connector assembly comprising:

a plurality of elongate electrical contacts, each said contact having a connection end, an opposed conductor terminating end and a central portion therebetween; said central portion including a first locking element adjacent said conductor terminating end and a second longitudinally spaced locking element adjacent said connection end; and an elongate insulative connector housing having an interconnection end and a contact insertion end for insertably supporting said contacts therein, said connector housing including:

a discrete initial contact support member positioned adjacent said contact insertion end; said initial contact support member including a plurality of initial apertures permitting insertable passage of said contacts through said initial contact support member in an insertion direction from said contact insertion end toward said interconnection end; said initial contact support member including engagement elements adjacent each initial aperture for locking engagement with said first locking elements of said contacts preventing inadvertent movement of said contact in a withdrawal direction opposite said first direction; and a discrete final contact support member movably positioned adjacent said interconnection end of said housing, said final contact support member including a plurality of first apertures; said first apertures being shaped to provide first aperture portions permitting passage of said second locking elements of said contacts therethrough in said first direction and second aperture portions in communication with first aperture portions, preventing passage of said second locking elements therethrough in said withdrawal direction; said final contact support member being movable within said housing to move from a first position permitting contact passage through said first apertures to a second position preventing contact passage through said first apertures.

2. An electrical connector assembly of claim 1 wherein said locking elements of said contacts are longitudinally spaced apart a given distance and wherein said initial contact support member and said final contact support member are longitudinally spaced apart said given distance.

3. An electrical connector assembly of claim 2 wherein said first locking element of each said contact includes an abutment surface facing said conductor terminating end and a tapered lead in surface facing said interconnection end and wherein said engagement elements include deflectable fingers supported adjacent each initial aperture, said fingers being deflectably engagable with said tapered lead in surface to permit passage of said first locking element therethrough in said insertion direction and being abutingly engagable with said abutment surface preventing inadvertent movement of said contact in said withdrawal direction.

4. An electrical connector assembly of claim 3 wherein said second locking element of each said contact includes an enlarged extent of said central portion; said enlarged extent being dimensioned to be insertably passable through said first aperture portion and dimensioned to be non-passable through said second aperture portion.

5. An electrical connector assembly of claim 4 wherein said enlarged extent of each said contact is dimensioned to pass through said initial apertures of said initial contact support member.

6. An electrical connector assembly of claim 5 wherein said contact central portion is generally cylindrical having a first diameter and wherein said first and second locking elements are generally cylindrical having diameters greater than said first diameter.

7. An electrical connector assembly of claim 6 wherein said initial apertures of said initial contact support member are circular having a diameter greater than said first and second locking elements.

8. An electrical connector assembly of claim 7 wherein a pair of said deflectable fingers are positioned adjacent each said initial aperture in diametrical opposition, said pair of fingers forming an elongate generally frustoconically shaped structure tapering toward said interconnection end of said housing, said diameter of said structure at the tapered end being less than the diameter of said first locking element.

9. An electrical connector assembly of claim 8 wherein said diameter of said tapered end of said structure is less than the diameter of said second locking element.

10. An electrical connector assembly of claim 6 wherein said first aperture portions of said final apertures of said final contact support member are generally circular having a diameter greater than the diameter of said second locking element to permit said insertable passage therethrough and wherein said second aperture portions are generally circular having a diameter less than the diameter of said second locking element preventing withdrawal passage therethrough.

11. An electrical connector assembly of claim 10 wherein said second locking element includes an abutment surface facing said conductor terminating end.

12. An electrical connector assembly of claim 11 wherein said abutment surface of said second locking element is engagable with a wall surface adjacent said second aperture portion of said final contact support member upon movement of said contact in said withdrawal direction.

13. An electrical connector assembly of claim 1 wherein said first and second locking elements of said contacts are spaced apart a given distance and wherein said initial contact support member and said final contact support member are spaced apart said given distance.

14. An electrical connector assembly of claim 13 wherein said engagement elements of said initial contact support member engage said first locking elements of said contacts independently of movement of said final contact support member from said first position to said second position.

* * * * *